United States Patent [19]

Meeker

[11] Patent Number: 4,681,087

[45] Date of Patent: Jul. 21, 1987

[54] WOODKILN COMBUSTION DEVICE

[76] Inventor: John G. Meeker, Deans Bridge Rd., Somers, N.Y. 10589

[21] Appl. No.: 858,419

[22] Filed: May 1, 1986

[51] Int. Cl.[4] ..... F24C 15/30

[52] U.S. Cl. ..... 126/126; 126/136; 126/67; 126/77; 126/83; 126/146; 126/292

[58] Field of Search ..... 126/64, 77, 83, 98, 126/146, 151, 292, 136, 135, 67, 126; 110/173 R, 173 C, 323; 160/DIG. 9, 214

[56] References Cited

U.S. PATENT DOCUMENTS

| | | | |
|---|---|---|---|
| 374,334 | 12/1886 | Backus | 126/136 |
| 1,668,911 | 5/1928 | Jowett | 126/292 |
| 2,419,379 | 4/1947 | Tindell, Jr. | 126/77 X |
| 3,082,759 | 3/1963 | David et al. | 126/135 |
| 4,134,104 | 12/1978 | Choate | 126/60 |
| 4,154,211 | 5/1979 | Choate | 126/60 |
| 4,182,302 | 1/1980 | Bruce et al. | 126/4 |
| 4,215,668 | 8/1980 | Holcombe et al. | 126/77 X |
| 4,236,500 | 12/1980 | Choate | 126/145 |
| 4,240,399 | 12/1980 | Choate | 126/58 |
| 4,306,538 | 12/1981 | Frieber | 126/290 |
| 4,347,831 | 9/1982 | Graziano | 126/77 X |
| 4,360,002 | 11/1982 | Choate | 126/190 |
| 4,479,483 | 10/1984 | Riahala | 126/292 |
| 4,611,572 | 9/1986 | Martenson | 126/83 X |

*Primary Examiner*—Randall L. Green

*Attorney, Agent, or Firm*—Pennie & Edmonds

[57] ABSTRACT

A wood burning device comprising a metal box with a flue, an automatic flue damper, a combustion chamber formed by layers of insulating refractory material, a transparent ceramic glass front, an insulated refractory baffle forming the top portion of the combustion chamber, a means for introducing air into the combustion chamber, and a smoke deflector upstream from the flue. The stove further includes a support for tilting the box backwards, and a latching mechanism for a slideable door on the ceramic glass front.

17 Claims, 9 Drawing Figures

WOODKILN COMBUSTION DEVICE

FIELD OF THE INVENTION

The present invention relates to a efficient, clean burning, and captivating wood burning device. More particularly, it relates to a wood burning device, having a metal box with an insulated refractory combustion chamber disposed within. The invention also relates to a ceramic glass front covering the combustion chamber, and a baffle forming the top portion of the combustion chamber.

BACKGROUND OF THE INVENTION

It is common knowledge that household fireplaces are generally inefficient as far as room heating is concerned. Most of the heat goes up the chimney rather than into the room. The heat generated in the conventional fireplace which does enter the room enters only by radiation. This heat is quite intense immediately in front of the fireplace; however, the air a few feet from the fireplace is hardly warmed. Generally, therefore, fireplaces as found in private dwellings are used more for their aesthetic appearance than their heating quality.

With the increasing cost of energy, the public has also demanded that their fireplaces become more efficient heat sources while keeping pollution to a minimum. Catalysts have been developed to answer some of these needs, but are expensive and have a limited life span. Additionally, most catalytic combustion systems operate at relatively low temperatures, thereby generating smoke which makes the combustion process unattractive to watch.

Another feature of the catalytic wood burners, is that it is generally necessary to have a heat exchanger, and a blower system to extract the heat. These add to the expense and complexities of the wood burners.

To obtain the efficiency associated with catalytic wood burners without the limitation of such designs, conventional wood burners have been designed to have a refractory lining. Examples of such a design are shown in U.S. Pat. Nos. 4,131,104; 4,154,211; 4,236,500; and 4,240,399 which disclose of front loading refractory lined wood burners having a top baffle heat exchanger. These wood burners, however, are not lined with insulating material, have no glass front to observe the fire, require a costly and complex system of multiple baffle means to cool the combustion gases before they reach the fire, are not inclined to eliminate the need for refractory material clips and create a hopper effect, does not have an automatically adjustable flue damper, and has metal directly exposed to the combustion.

SUMMARY OF THE INVENTION

An object of the invention is to provide an efficient clean burning, and captivating wood burning device without expensive or complex catalyst and blower systems. The present invention can be a freestanding fireplace, an insert into an existing fireplace, or a zero clearance fireplace. Its objectives are accomplished by having a kiln-like combustion chamber covered by ceramic glass.

Specifically, the wood burning device is constructed as a metal box having a top with an exhaust opening which permits the gases and products of combustion to exit the wood burning device. The front of the box has an access opening through which logs can be inserted.

The combustion chamber is defined within the metal box by layers of insulated refractory materials which line the walls of the box. These materials give the combustion chamber its kiln-like qualities.

Covering the front access opening of the wood burning device is a transparent ceramic glass front. This glass permits the transmission of radiant heat energy outside the wood burning stove while enabling the combustion process to be viewed. The glass front includes a fixed upper member, or upper part, lying in an inclined vertical plane supported underneath at its outer bottom edges by ceramic strips that are vertically aligned with the upper member, and a lower member, or lower part, slidably mounted relative to the upper member and ceramic strips. The lower member moves from a closed position, closing the bottom front of the box, to one or more open positions overlying the upper member to provide an access opening in the lower front of the box permitting the loading of logs or other objects to be burned. Fixing the ceramic strips and upper member of the wood burning stove are inwardly extending plates that are fixed to the stove. These plates also form the track in which the sliding lower glass part moves. Attached to the inwardly extending plates is a set of inwardly extending tabs that overlaps the lower glass part so as to hold the lower glass part in contact with the ceramic strips and the fixed glass part. These tabs prevent a rolling log from knocking out the lower glass part in the closed position.

Forming the top part of the combustion chamber is an insulated refractory baffle. The baffle has a front edge spaced from the upper member of the glass front to form a front gap. The baffle is also spaced below the top wall of the metal box. The purpose of the baffle is to restrict the flow of the products of combustion in the wood burning device by forcing the gases and particulate materials to follow the contour of the baffle before existing the combustion chamber. Additionally, the baffle allows more of the combustion process to be viewed, compared to a similar-sized wood burner, because the baffle slopes upwards toward the top of the box.

To further restrict the flow, a smoke deflecting means, fixed between the baffle and the top plate of the metal box at a point just upstream of the flue, is used. The deflecting means is made of high density refractory board and extends rearwards to form a vee around the flue opening so as to provide gaps which force the products of combustion to take a circuitous route before entering the flue.

Since the wood burning device is a low draft container, a means for introducing preheated air into the combustion chamber is provided. The air induction means consists of at least one air passage, in a vertically titled plane, formed by spacing panels of high density refractory board, that are fixed between the insulation and the insulating fire brick in the lower back of the metal box. The panels are also underneath the high density refractory board, in the upper back of metal box 2, so as to support the high density refractory board in a stationary vertically titled plane and thereby forming at least one outlet at the midway point up the back of the combustion chamber. In the air passage, the residual heat in the refractory fire brick is transferred to the air passage, thereby heating the air before it is injected into the hottest part of the fire at the outlet so that the efficiency of the combustion process is enhanced and puffing is prevented. To supply air into the air passage there is at least one inlet. The inlet is connected to the lower portion of the air passage and is positioned and passes through the bottom rear portion of the metal box.

Another feature of the wood burning device is an automatically adjustable flue damper. The damper has a support plate that is attached to the interior sides of the flue, and a flap that is connected by a hinge to the support plate. The flap moves from an open position, in which the flap hangs downwards, to a closed position in which the flap is essentially perpendicular to the flue sides. Flap movement is activated by a pressure differential in the flue which is caused when the air upstream of the flue damper gets considerably hotter than the ambient air. The damper can also be operated manually and has a means for stopping the flap from rotating past the closed position The stopping means can be a spring in and around the hinge or it can be a tab on the flue or on the support plate.

To hold the slideable member in the raised, open position, a latching means is provided. The latching means includes one metal clip affixed on either side of the slideable member, a metal sleeve that is affixed to the clips to define an axially aligned passage parallel to the slideable member, a metal rod rotatably inserted the parallel passages, a set of handles attached at the ends of the metal rod, and hooks that are affixed on either side of rod between the handles and the side edges. To engage the hook, thereby holding the lower slideable member in the open position, are a number of tabs that extend forward from the front edge plates.

In an alternative embodiment, the lower slideable member is held open in a raised position by resting the metal rod itself on the hooks. This is accomplished by lifting the lower slideable member outward, from the wood burning device, and over the hooks.

Other objects, features, and advantages of the invention will be apparent from the following detailed description of a preferred embodiment, with reference to the accompanying drawings.

DETAILED DESCRIPTION OF THE PREFERRED EMBODIMENT

Figure 2:
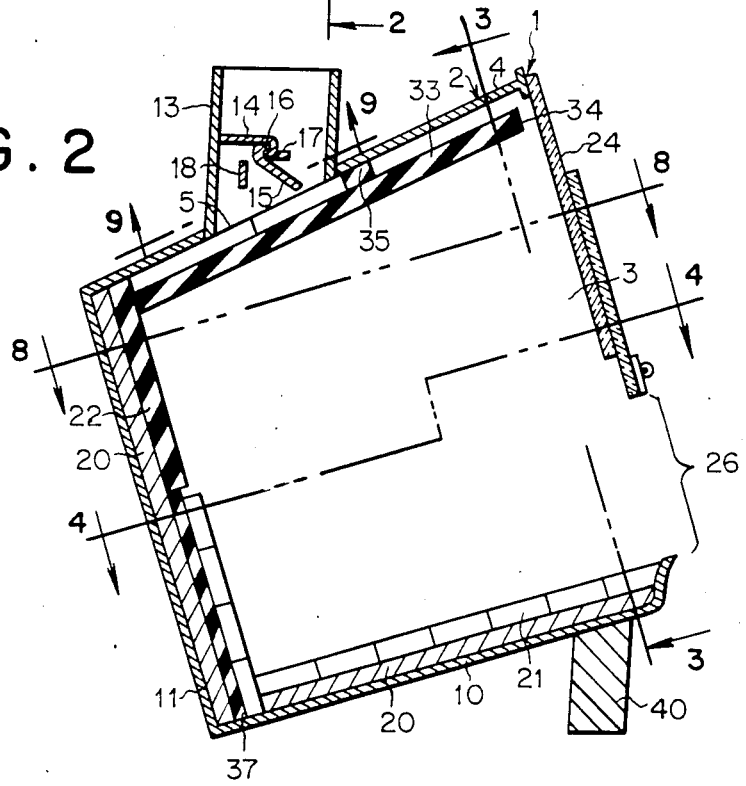
FIG. 2 is a cross-sectional view taken along lines 2—2 of FIG. 1.

The wood burning device 1 includes a metal box 2 with a combustion chamber 3 shown in FIG. 2, disposed therein. The metal box 2 has a top 4 with an exhaust opening 5, shown in FIG. 2, which permits the gases and products of combustion to exit from the metal box 2. Depending from said top plate 4 are front edge plates 6 and 7, and side plates 8 and 9 shown in FIG. 4. Connected to the side plates 8 and 9, and the front edge plates 6 and 7, is bottom plate 10 shown in FIG. 2. Finally, back plate 11 is connected to side plates 8 and 9, bottom plate 10, and top plate 4.

Figure 3:
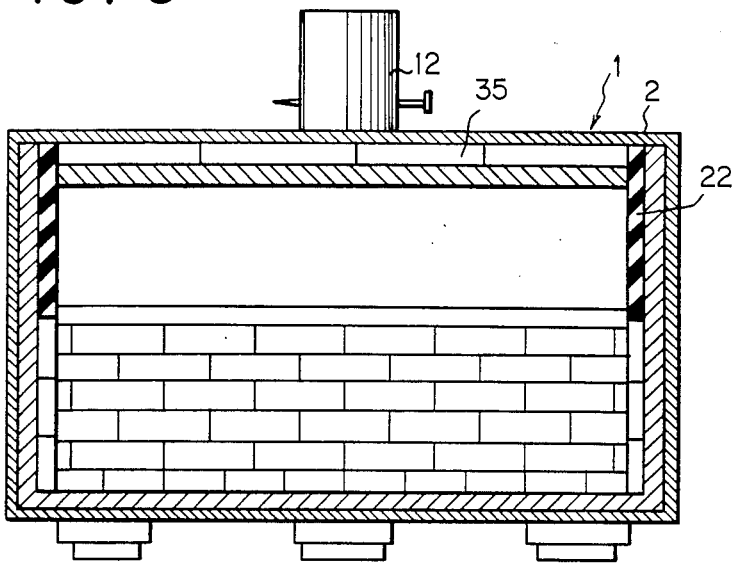
FIG. 3 is cross-sectional view taken along line 3—3 of FIG. 2.
Figure 9:
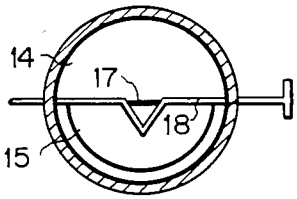
FIG. 9 is a cross-sectional view taken along line 9—9 of FIG. 2.

Attached to the top plate 4 is flue 12, shown in FIG. 3. The flue is aligned with the exhaust opening 5, as shown in FIG. 2, and has a flue damper 13 disposed within. The purpose of the flue damper is to limit the maximum burn rate in the combustion chamber 3, thereby limiting the maximum temperatures within the wood burning device 1. In the preferred embodiment, the flue damper would automatically operate and include as shown in FIG. 2 and FIG. 9, a semicircular support plate 14 fixed to the interior sides of the flue 12, a semi-circular rotating flap 15, connected by a hinge 16 to the support plate 14 and spaced from the sides of the flue, a tab 17 for preventing the flap from over rotating, and a bent rod 18 for manually adjusting the flap without overriding the automatic feature of the flue. Flap 15 moves from an open first position, in which flap 15 hangs downwards, to a closed second position in which the flap is essential perpendicular to the sides of flue 15, when a sufficient pressure differential exists to move the flap upwards. This pressure differential is caused when the air upstream of the flue damper gets considerable hotter, due to overheating in combustion chamber 3, than the ambient air.

Preventing flap 15 from over rotating past the closed position is tab 17. Tab 17 is attached to support plate 14 and extends inward to contact flap 15 when flap 15 rotates past the closed position. In alternate embodiments, tab 17 could be mounted on the flue wall or spring means on or around the hinge could be used to prevent flap 15 from overrotating.

To manually adjust flap 15 of flue damper 13, bent rod 18 passes through flue 12, and rotates to engage flap 15 and move it upwards. The manual adjustment, however, will not override the automatic feature because rod 18 does not impede flap 15 from moving upwards.

Figure 4:
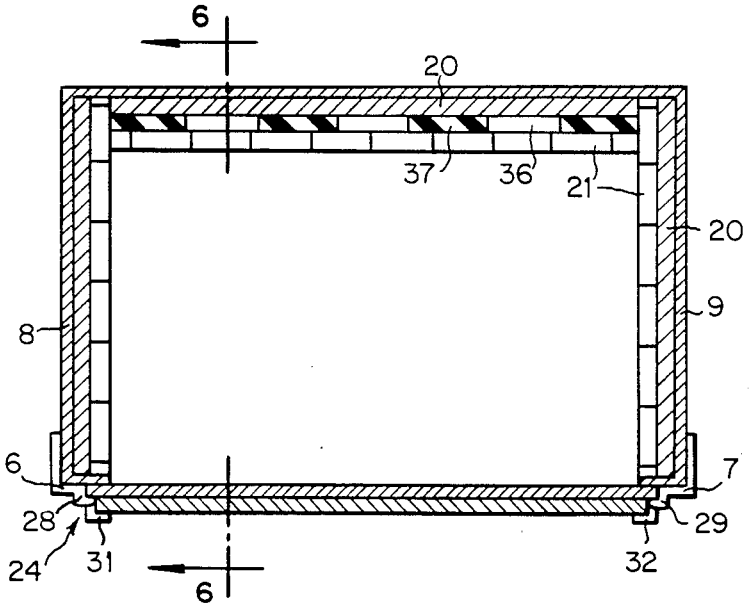
FIG. 4 is cross-sectional view taken along line 4—4 of FIG. 2.
Figure 8:
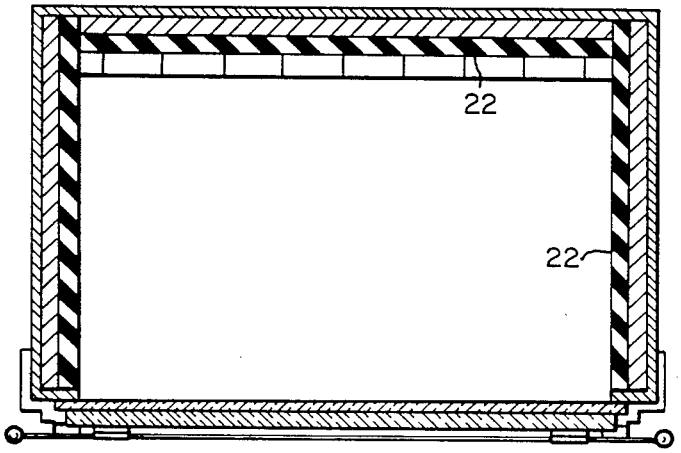
FIG. 8 is a cross-sectional view taken along line 8—8 of FIG. 2.

The combustion chamber 3, is formed by different layers of insulating and refractory material 19. The material includes, as shown in FIGS. 2, 3, and 4, a layer of insulation 20 affixed to the inner surfaces of the back plate 11, side plates 8 and 9, and bottom plate 10. Adjacent to the layer of insulation 20 at the back and lower sides of metal box 2 is a layer of insulating fire brick 21. Against the layer of insulation 20 at the upper back and sides is a layer of high density refractory board 22, as shown in FIG. 8. One advantage of having the refractory materials 21 and 22 enclosed within separate insulation is that it creates a hotter environment in the combustion chamber, thereby making the burning process cleaner and more efficient. By maintaining most of the heat within the combustion chamber, most of the fuel is burned away leaving nothing but a grey ash. Consequently, the metal box 2 can be made of lighter gauge steel because it will be subjected to less heat. Another advantage of using insulated refractory material is that the heat generated in the combustion chamber 3, is directed outward through the front of the wood burning device, thereby eliminating the need for a blower system in most applications. In the preferred embodiment, both insulation 20 and fire brick 21 would be one inch thick.

Figure 6:
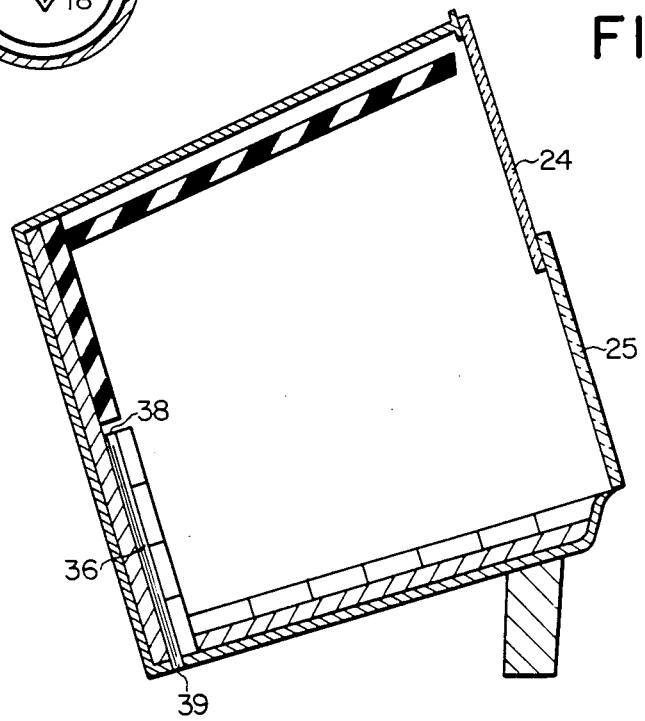
FIG. 6 is a cross-sectional view taken along line 6—6 of FIG. 4.

Covering the front of the stove is a transparent, ceramic glass baffle and door front structure 23. More particularly, the front structure includes an upper stationary ceramic glass member 24 positioned in a vertically tilted plane and a lower slideable ceramic glass member 25, moveable in the vertically tilted direction parallel to the stationary member 24 (FIG. 6). The lower slideable member moves between a first position shown in FIG. 6, to one or more open positions, shown in FIG. 2, in which an access opening 26 is opened to allow for the loading of fuel. The degree in which access opening 25 is opened depends on the amount of smoke in combustion chamber 3.

Figure 5:
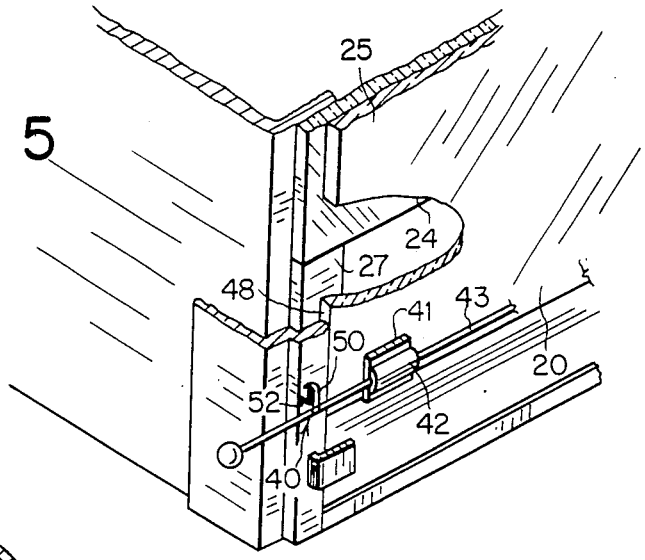
FIG. 5 is a perspective view of the front corner of the appliance showing the latching means for the front sliding plate of the stove.
Figure 7:
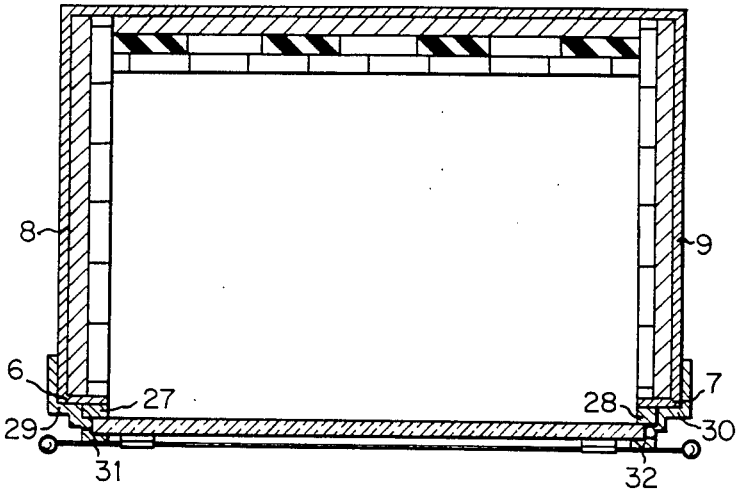
FIG. 7 is a cross-sectional view taken along line 7—7 of FIG. 1.

Supporting the upper stationary member 24 at its outer bottom edges are ceramic glass strips 27 and 28, shown in FIGS. 5 and 7. Ceramic strips 27 and 28 are vertically aligned with upper member 24 to provide a bearing surface for slidable member 25. The advantage of the ceramic strips is that a tight seal is achieved between the ceramic glass front structure 23 and front edge plates 6 and 7, thereby limiting the exposure of metal box 2 to the combustion heat.

To prevent glass front structure 23 from moving laterally or outwards, a set of inwardly extending plates 29 and 30 are attached to front edge plates 6 and 7 and overlap ceramic strips 27 and 28 and upper glass member 24. Inwardly extending plates 29 and 30 press ceramic strips 27 and 28 and upper glass member 24 against metal box 2 while also providing a vertical track in which slidable member 25 can move. Attached to plates 29 and 30 are a set of inwardly extending tabs 31 and 32. Tabs 31 and 32 overlap slidable member 25 in contact with ceramic strips 27 and 28 and upper glass member 24 in the closed position. Slidable member 25 is thereby prevented from being knocked out by a rolling log.

Forming the top part of the combustion chamber 3, is an insulated refractory baffle 33, shown in FIG. 2, that extends forward and upward from the top back section of combustion chamber 3. The insulated refractory baffle is formed from a layer of high density refractory board. The insulated refractory baffle has a front edge 34 that is spaced from the upper member ceramic front 24. One of the advantages of such a design is that the combustion gases are cooled before contacting the top plate 4. By forcing the gases to be evenly distributed across upper member 24 and the baffle front edge 34, the heat transfer from the gases through upper member 24 is enhanced, thereby cooling the gases. Another benefit of spacing upper member 24 near insulated refractory baffle 34 is that the gas flow into the baffle is choked. By choking the flow, the gases are kept in the combustion chamber 3 longer, thereby permitting the products of combustion to be burned up. The result of which is that the combustion process is cleaner and more efficient.

Working in conjunction with insulated baffle 34 to further restrict the gas flow is a smoke deflecting means 35. The smoke deflecting means, which is formed from a layer of high density refractory board, is fixed between insulated refractory baffle 34 and the top plate 4 at a point just upstream of exhaust opening 5. Deflecting means 35 extends rearwards to form a vee around flue 12, and is spaced from the sides of metal box 2, as shown in FIG. 3, so as to provide gaps which force the products of combustion to take a circuitous route before entering flue 12. By forcing the products of combustion to take a circuitous route, the products of combustion are kept in the baffle 34 longer, thereby allowing the heat in the gases and in the particulate materials to radiate through metal box 7. Consequently, the products of combustion are cooled before entering flue 12.

Since the wood burning device 1 is a low draft device, a means for introducing preheated air into the combustion chamber 3 is provided. The air induction means consists of at least one air passage 36, shown in FIG. 4, in a vertically tilted plane, formed by spacing panels 37, of high density refractory board, that are fixed between insulation 20 and insulated fire brick 21 in the lower back of metal box 2. Panels 37 are also underneath the high density refractory board 22, in the upper back of metal box 2, shown in FIG. 2 and FIG. 6, so as to support the high density refractory board 22 in a stationary vertically titled plane and thereby forming at least one outlet 38 at the midway point up the back of combustion chamber 3. In air passage 36, the residual heat in refractory fire brick 21 is transferred to the air passage 36, thereby heating the air before it is injected into the hottest part of the fire at outlet 38 so that the efficiency of the combustion process is enhanced and puffing is prevented. To supply air into passage 36 is at least one inlet 39. Inlet 39 are connected to the lower portion of passage 36, and is positioned and passes through the bottom rear portion of metal box 2.

In the preferred embodiment, the wood burning device 1 is tilted with its front facing upwardly as shown in FIG. 2. For this purpose, there is attached to the front section of bottom plate 10, at least one support post 40. One advantage of a tilted wood burning device 1, is that the angled front reduces the radiant heat passing through the ceramic members 24 and 25 that would otherwise hit the floor if the front of the wood burning device was in an upright, vertical position. Other benefits of the tilted design are that ash removal is simplified because no front lip is required, and that a hopper effect, i.e. the logs are held in readiness prior to being consumed in the fire, is created when several logs are loaded The tilted stove also permits both the insulating fire brick 21 and slideable member 25 to be gravitationally held in place. The advantage of this design is that fewer parts are needed to mount, maintain and operate the stove. Specifically, the tilted design eliminates the need for metal retainers for fire brick 21, and for a pressure device to hold slidable member 25 in contact with ceramic strips 27 and 28 and upper member 24. Therefore, there is no exposed metal inside wood burning device 1. Additionally, since the stove 1, can also be used as an insert into a fireplace, the tilted design allows for an easier fit. In the preferred embodiment, the stove should be tilted at a 16° angle.

Figure 1:
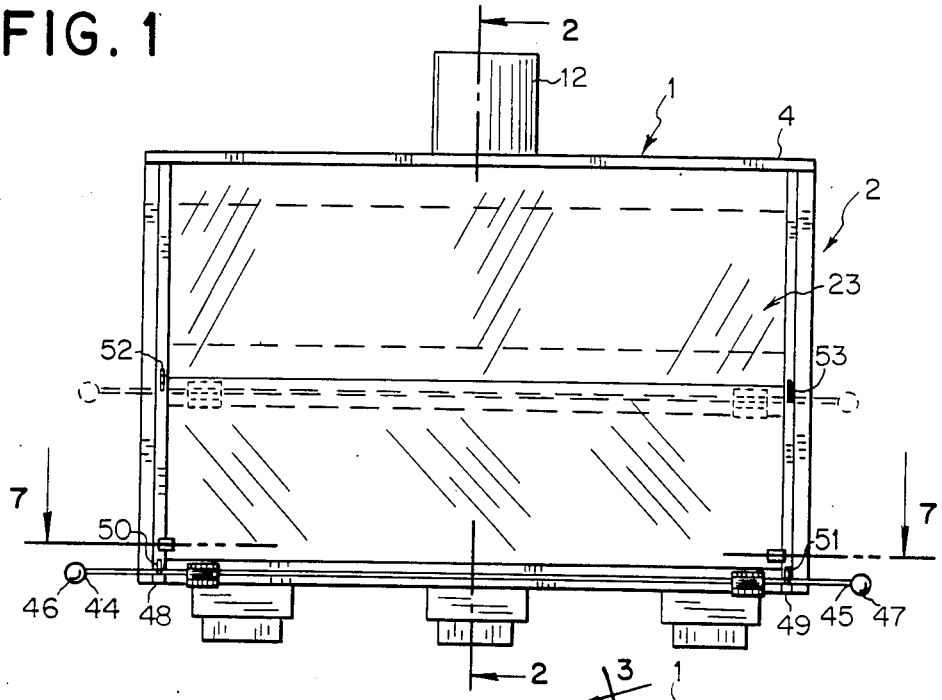
FIG. 1 is a front plan view of the wood burning device of the present invention.

To hold the slideable member 25 in the raised, open position, a latching means 40 is provided. As shown in FIG. 5, the latching means 40 includes one metal clip 41 affixed on either side of slideable member 25. A metal sleeve 42 is affixed to the clips 41, and defines an axially aligned passage parallel to slideable member 25. Rotatably inserted in sleeve 42 is a metal rod 43. At the ends 44 and 45 of rod 42, shown in FIG. 1, a set of handles 46 and 47 are attached. Between the handles 46 and 47 and the side edges 48 and 49 of slideable member 25, are hooks 50 and 51 that are affixed on either side of rod 44. A number of tabs 52 and 53 extend forward from front edge plates 6 and 7, so that hooks 50 and 51 can be engaged thereby holding lower slideable member in the open position.

I claim:

1. A wood burning device comprising:

(a) top, back, side and bottom members and front edge members connected together to define a box and a combustion chamber therein, having an open front and said bottom member providing means for supporting fuel to be burned in the combustion chamber;

(b) ceramic glass front connected to the front edge members, said front having (1) an upper part fixed to the front edge member to close the top front of the box, and (2) a lower part mounted for sliding movement between a closed position closing the bottom front of the box to one or more open positions overlying the upper part to provide an access opening in the lower front of the box (c) means for supporting the box with the front facing upwardly at an acute angle to the horizontal;

(d) an air induction means for supplying air into said combustion chamber and associated with one of said members; and (e) an exhaust opening on the top member of the box for exhausting the interior of the combustion chamber.

2. The wood burning device according to claim 1 further comprising:

(a) a baffle member disposed within the box adjacent to but spaced from the top member of the box, said baffle member extending from the back of the box to a location spaced from the front to define a front gap through which products of combustion pass from the burning fuel to the exhaust opening means thereby directing the products of combustion upwardly along the ceramic parts of the front of the stove.

3. The wood burning device according to claim 2 further comprising:

(a) heat insulation material disposed along the bottom, sides and back interior sections of the box; and (b) refractory material adjacent to the insulation material along said bottom, sides and back section

4. The wood burning stove according to claim 3 further comprising:

(a) a plurality of ceramic strips that are in the same titled vertical plane and underneath the outer bottom edges of the fixed glass part so as to provide a bearing surface for the lower glass part and to hold the fixed glass part in a stationary vertical position.

5. The wood burning device according to claim 4 wherein:

(a) the baffle is formed from insulating refractory material

6. The wood burning device according to claim 5 further comprising:

(a) a smoke deflecting means that is fixed between the baffle and the top member of the box, at a point just upstream of the exhaust opening, so as to force the products of combustion to follow a circuitous route before reaching the exhaust opening.

7. The wood burning device according to claim 6 further comprising:

(a) a flue aligned with the exhaust opening and is attached to the top member; and (b) a flue damper disposed within the flue to regulate the temperature of the stove.

8. The wood burning device according to claim 7 further comprising:

(a) a set of inwardly extending plates attached to the front edge members, that overlap the ceramic strips and the fixed glass part, and thereby press the ceramic strips and fixed glass part against the front edge members; and (b) a set of inwardly extending tabs, attached to the inwardly extending plates, that overlap the lower glass part so as to hold the lower glass part in contact with the ceramic strips and the fixed glass part in the closed position.

9. The wood burning device according to claim 8 further comprising:

(a) a latching means for holding the lower part in at least one open position.

10. The wood burning device according to claim 9 wherein:

(a) the ceramic glass front is transparent.

11. The wood burning device according to claim 10 wherein:

(a) the refractory material in the bottom, the lower back, and the lower sides of the box consists of insulating refractory fire brick; and (b) the refractory material in the upper back and sides of the box consists of high density refractory board.

12. The wood burning device according to claim 11

(a) the baffle is formed from a layer of high density refractory board.

13. The wood burning device according to claim 12 wherein:

(a) the air induction means includes:

(1) at least one spacing panel of high density refractory board, fixed between the insulation and the insulating refractory fire brick in the lower back of the box, forms at least one air passage for heating the air within the passages with the residual heat in the insulating refractory fire bricks, and is underneath the high density refractory board in the upper back of the box so as to support the high density refractory board in a stationary vertically titled plane;

(2) at least one inlet, connected to the lower portion of the air passage, positioned at the bottom rear portion of the box, and passing through the bottom of the box; and (3) at least one outlet, formed by the connection of the spacing panels in the lower back of the box with the high density refractory board in the upper back of the box, leads into the combustion chamber at a midway point up the back of the combustion chamber so that the air is introduced close to the hottest part of the fire.

14. The wood burning device according to claim 13 wherein:

(a) the smoke deflecting means is formed from a layer of high density refractory board that extends rearwards to form a vee around the flue, and is spaced from the sides of the box to provide gaps in which products of combustion pass before entering the flue.

15. The wood burning device according to claim 14 wherein:

(a) the latching means includes:

(1) at least one metal clip affixed on either side of the lower part;

(2) at least one metal sleeve, affixed to the metal clip, defining an axially aligned passage between the clips which is parallel to the bottom edge of the lower part;

(3) a metal rod rotatably inserted into the sleeves;

(4) a set of handles attached at the ends of the metal rod;

(5) a set of hooks, affixed to the metal rod at a point that is between the side edges of the lower part and the handles.

(6)a number of tabs, extending forwards from the front edge plates to engage the hooks thereby holding the lower part in the open position.

16. The wood burning device according to claim 15 wherein:

(a) the flue damper includes:

(1) a semi-circular support plate fixed to the interior sides of the flue;

(2) a flap, hingeably connected to the support plate and spaced from the side of the flue, moveable between a first open position, in which the flap hangs downwards, to a closed second position, in which the flap is essential perpendicular to the flue side, in response to a pressure force due to the temperature differential between the air upstream of the flue damper and the ambient air;

(3) means for preventing the flap from rotating past the closed position; and (4) a means for manually adjusting the flap without overriding the automatic feature of the flue damper.

17. The wood burning device according to claim 16 wherein:

(a) the means for preventing the flap from rotating comprises of a tab connected to the support plate, that extends inwards to contact the flap when the flap rotates past the closed position;

(b) the flap is semi-circular shaped and defines a semi-circular gap with the flue; and (c) the means for manually adjusting the flap comprises a bent rod, passing through the flue, that when rotated contacts the flap and moves it upwards.

* * * * *